US008564275B2

(12) United States Patent
Seok et al.

(10) Patent No.: US 8,564,275 B2
(45) Date of Patent: Oct. 22, 2013

(54) REFERENCE VOLTAGE GENERATOR HAVING A TWO TRANSISTOR DESIGN

(75) Inventors: Mingoo Seok, Ann Arbor, MI (US); Dennis Sylvester, Ann Arbor, MI (US); David Blaauw, Ann Arbor, MI (US); Scott Hanson, Waterford, MI (US); Gregory Chen, Ann Arbor, MI (US)

(73) Assignee: The Regents of the University of Michigan, Ann Arbor, MI (US)

( * ) Notice: Subject to any disclaimer, the term of this patent is extended or adjusted under 35 U.S.C. 154(b) by 405 days.

(21) Appl. No.: 12/823,160

(22) Filed: Jun. 25, 2010

(65) Prior Publication Data

US 2010/0327842 A1 Dec. 30, 2010

Related U.S. Application Data

(60) Provisional application No. 61/220,712, filed on Jun. 26, 2009.

(51) Int. Cl.
*G05F 3/16* (2006.01)

(52) U.S. Cl.
USPC ..... 323/313

(58) Field of Classification Search
USPC ..... 327/513, 530, 534, 535, 537, 538, 543; 323/311–314
See application file for complete search history.

(56) References Cited

U.S. PATENT DOCUMENTS

| | | | | |
|---|---|---|---|---|
| 4,609,833 | A * | 9/1986 | Guterman | 327/537 |
| 4,814,686 | A * | 3/1989 | Watanabe | 323/229 |
| 5,568,093 | A * | 10/1996 | Holzer | 330/264 |
| 6,275,100 | B1 | 8/2001 | Park et al. | |
| 6,700,363 | B2 * | 3/2004 | Tachimori | 323/313 |
| 7,038,530 | B2 * | 5/2006 | Chou | 327/543 |
| 7,242,241 | B2 * | 7/2007 | Toumazou et al. | 327/543 |
| 2004/0257149 | A1 | 12/2004 | Baskett | |
| 2004/0263240 | A1 | 12/2004 | Fulton et al. | |

OTHER PUBLICATIONS

B.S. Song et al., "A Precision Curvature-Compensated CMOS Bandgap Reference", IEEE Journal of Solid-State Circuits, Dec. 1983.

H.W. Huang et al., "A 1V 16.9ppm/° C. 250nA Switched-Capacitor CMOS Voltage Reference", IEEE International Solid-State Circuits Conference 2008.

M. Ugajin et al., "A 0.6-V Voltage Reference Circuit Based on $\Sigma$-$V_{TH}$ Architecture in CMOS/SIMOX", IEEE Symposium on VLSI Circuits, 2001.

G.D. Vita et al., "A Sub-1-V, 10 ppm/° C., Nanopower Voltage Reference Generator", IEEE Journal of Solid-State Circuits, 2007.

K.N. Leung et al., "A Sub 1-V 15-ppm/° C. CMOS Bandgap Voltage Reference Without Requiring Low Threshold Voltage Device," IEEE Journal of Solid-State Circuits, vol. 37, No. 4, Apr. 2002.

(Continued)

*Primary Examiner* — Adolf Berhane
(74) *Attorney, Agent, or Firm* — Harness, Dickey & Pierce, P.L.C.

(57) ABSTRACT

An improved voltage reference generator is provided. The voltage reference generator comprises: a first transistor having a gate electrode biased to place the first transistor in a weak inversion mode; and a second transistor connected in series with said first transistor and having a gate electrode biased to place the second transistor in a weak inversion mode, where the threshold voltage of the first transistor is smaller than the threshold voltage of the second transistor and the gate electrode of the second transistor is electrically coupled to a drain electrode of the second transistor and the source electrode of the first transistor to form an output for a reference voltage.

23 Claims, 5 Drawing Sheets

(56) References Cited

OTHER PUBLICATIONS

P. Kinget, et al., "Voltage References for Ultra-Low Supply Voltages," IEEE Custom Integrated Circuits Conference, 2008.

J. Doyle, et al., "A CMOS Subbandgap Reference Circuit With 1-V Power Supply Voltage", IEEE Journal of Solid-State Circuits, vol. 39, No. 1, Jan. 2004.

A. Boni, et al., "Op-Amps and Startup Circuits for CMOS Bandgap References With Near 1-V Supply", IEEE Journal of Solid-State Circuits, vol. 37, No. 10, Oct. 2002.

A. Annema et al., "A Sub-1V Bandgap Voltage Reference in 32 nm FinFET Technology", Int. Solid-State Circuits Conference, 2009.

K.N. Leung et al., "A CMOS Voltage Reference Based on Weighted ΔVGS for CMOS Low-Dropout Linear Regulators", IEEE Journal of Solid-State Circuits, 2003.

* cited by examiner

REFERENCE VOLTAGE GENERATOR HAVING A TWO TRANSISTOR DESIGN

CROSS-REFERENCE TO RELATED APPLICATIONS

This application claims the benefit of U.S. Provisional Application No. 61/220,712 filed on Jun. 26, 2009. The entire disclosure of the above application is incorporated herein by reference.

GOVERNMENT INTEREST

This invention was made with government support under Grant No. EEC9986866 awarded by the National Science Foundation. The government has certain rights in the invention.

FIELD

The present disclosure relates to an improved reference voltage generator that improves power consumption, size and ease of design with comparable temperature, supply voltage and process insensitivity to existing designs.

BACKGROUND AND SUMMARY

Recent progress in ultra-low power (ULP) circuit design has been made due to significant interest in environmental and biomedical sensor applications. These systems often include analog and mixed-signal modules such as linear regulators, A/D converters, and RF communication blocks for self-contained functionality.

Voltage references (VR) are key building blocks for these modules. In particular, linear regulators require a voltage reference to supply a constant voltage level to the entire system. Also, amplifiers in A/D converters employ several bias voltages. Therefore, it is often necessary to incorporate multiple voltage reference circuits in a system.

Voltage references are commonly integrated in wireless sensing systems with tight power budgets, which are often less than hundreds of nanowatts due to very limited energy sources. Hence, it is vital that voltage references consume very little power. On the other hand, voltage references should be able to operate across a wide $V_{dd}$ range, in particular near or below 1V, since some power sources, such as energy scavenging units, provide low output voltages.

This section provides background information related to the present disclosure which is not necessarily prior art.

SUMMARY

An improved voltage reference generator is provided. The voltage reference generator comprises: a first transistor having a gate electrode biased to place the first transistor in a weak inversion mode; and a second transistor connected in series with said first transistor and having a gate electrode biased to place the second transistor in a weak inversion mode, where the threshold voltage of the first transistor is smaller than the threshold voltage of the second transistor and the gate electrode of the second transistor is electrically coupled to a drain electrode of the second transistor and the source electrode of the first transistor to form an output for a reference voltage.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

Figure 1A:
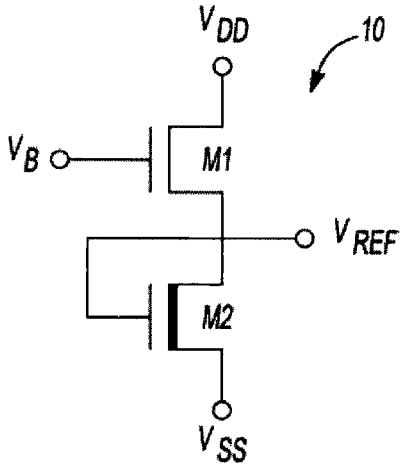
FIGS. 1A and 1B are schematics of an improved voltage reference generator implemented with n-type transistors and p-type transistors, respectively.

The drawings described herein are for illustrative purposes only of selected embodiments and not all possible implementations, and are not intended to limit the scope of the present disclosure. Corresponding reference numerals indicate corresponding parts throughout the several views of the drawings.

DETAILED DESCRIPTION

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure.

Figure 1B:
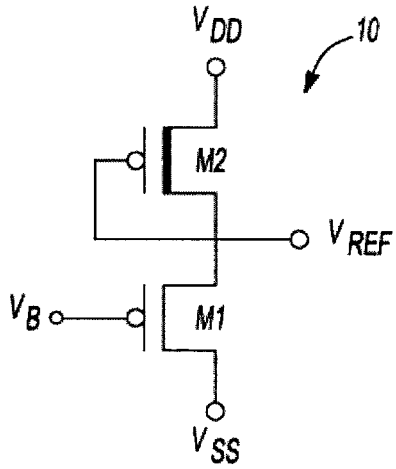

FIGS. 1A and 1B illustrate a basic circuit structure for an improved voltage reference generator 10 according to the principles of this disclosure. The voltage reference generator 10 is comprised of two transistors M1 and M2 connected in series between a supply voltage ($V_{DD}$) and a ground voltage ($V_{SS}$). Both $V_{DD}$ and $V_{SS}$ may be traditional supply voltages (e.g., drawn from a power supply or battery) or they may be reference voltages generated elsewhere (e.g., any kind of reference voltage generators including the proposing techniques).

With only two transistors, the voltage reference generator is both smaller and simpler than existing designs. This is valuable not only to minimize circuit area, power and cost but also to minimize the time required to design the voltage reference generator.

Of note, the threshold voltage of the first transistor M1 is less than threshold voltage of the second transistor M2. For clarity, the transistor having the greater threshold voltage is indicated with a thicker bar in the accompanying figures. Different ways for achieving a desired threshold voltage are contemplated by this disclosure and may include but is not limited to different threshold implants, different transistor gate sizes, different oxide thicknesses and different body biases. In any case, the difference between the first threshold voltage and the second threshold voltage will typically exceed 150 millivolts and preferably 200 millivolts to achieve the most desirable operating characteristics. However, the design will function at smaller differences.

During operation, the gate-source voltages of the first transistor M1 and the second transistor M2 must be set to ensure that both transistors are operated in a weak inversion operating mode (also commonly referred to as a subthreshold region). By operating the transistors in a weak inversion mode (rather than in a saturation region), power consumption of the generator is reduced dramatically as compared to existing designs. Furthermore, operation in a weak inversion mode ensures that the voltage reference generator can operate with supply voltage (VDD) much less than 1V. For improved performance, the drain-source voltages on M1 and M2 should be greater than approximately $3v_T$, where $v_T$ is the thermal voltage. Combining these assumptions with a well-known subthreshold current equation shows that the value of the reference voltage $V_{REF}$ is:

$$V_{REF} = \frac{1}{m_1 + m_2}\left(m_1 \cdot V_{th,2} - m_2 \cdot V_{th,1} + m_2 \cdot V_B + m_1 m_2 v_T \ln\left(\frac{\mu_1 \cdot C_{ox,1} \cdot W_1 / L_1 \cdot (m_1 - 1)}{\mu_2 \cdot C_{ox,2} \cdot W_2 / L_2 \cdot (m_2 - 1)}\right)\right)$$

where $m_i$ is the subthreshold slope factor for transistor $M_i$, $V_{th,i}$ is the threshold voltage for transistor $M_i$, $\mu_i$ is the mobility for transistor Mi, $W_i$ is the gate width for transistor $M_i$, and $L_i$ is the gate length for transistor $M_i$. The only temperature-dependent quantities are $V_{th,1}$, $V_{th,2}$, and $v_T$, which have a linear dependence on temperature. Note that $V_B$ may also have a temperature dependence but is further discussed below. The reference voltage $V_{REF}$ is therefore a linear function of temperature (where the linear slope may be zero, indicating temperature insensitivity) that may be tuned by changing transistor dimensions ($W_1$, $L_1$, $W_2$, $L_2$).

Through transistor sizing, the temperature dependence of $V_{REF}$ can be changed from proportional-to-absolute temperature (PTAT) to complementary-to-absolute temperature (CTAT) to temperature-independent. In a typical implementation, the gate width of transistor M1 would be chosen relative to the gate width of transistor M2 to make $V_{REF}$ insensitive to temperature. In addition to affecting the temperature sensitivity of $V_{REF}$, the gate sizes of transistor M1 and transistor M2 affect the power consumption of the voltage reference generator. For example, choosing transistors M1 and M2 to have narrow width or long length would reduce the power consumption of the voltage reference generator substantially.

Since coupling though the parasitic MOSFET capacitance can affect power supply rejection ratio, an output capacitor may be added for signal robustness. Larger output capacitance provides a better power supply rejection ratio.

In an exemplary embodiment, the gate electrode of first transistor M1 is tied to a bias voltage ($V_B$) that biases this transistor into a weak inversion mode. The second transistor M2 is configured as a diode-connected transistor, with its gate electrode tied to its drain electrode such that this shared gate/drain terminal serves as the output of the reference voltage generator, $V_{REF}$. Other transistor configurations which meet the operating criteria set forth above are envisioned by this disclosure.

FIG. 1A depicts the voltage reference generator 10 implemented with n-type transistors. In this arrangement, the drain electrode of the first transistor M1 is electrically coupled to a supply voltage, the source electrode of the first transistor is electrically coupled to the drain electrode of the second transistor, and the source electrode of the second transistor is electrically coupled to a ground voltage.

Conversely, the voltage reference generator 10 implemented with p-type transistors is depicted in FIG. 1B. Thus, the source electrode of the second transistor is electrically coupled to a supply voltage, the drain electrode of the second transistor is electrically coupled to the source electrode of the first transistor, and the drain electrode of the first transistor is electrically coupled to a ground voltage. In this way, the reference voltage is referenced to $V_{DD}$ rather than $V_{SS}$.

In the exemplary embodiment, the first and second transistors are further defined as metal oxide semiconductor field effect transistors. More specifically, the first transistor M1 may be implemented with a MOSFET transistor having a near-zero threshold voltage $V_{th}$ (ZVT) such that it remains in weak inversion mode even at negative $V_{gs}$. These types of ZVT devices are widely available in foundry technologies ranging from 0.25 μm to 65 nm. The second transistor M2 may be implemented with an input/output MOSFET device. Both transistors have thick gate oxides to support operation across a wide range of $V_{dd}$. Other types of transistors are contemplated by this disclosure.

The reference voltage generator 10 has been simulated extensively and fabricated in multiple industry-standard circuit processes including a 0.18 μm process, a 0.13 μm process, and a 65 nm process. One exemplary reference voltage generator fabricated in a 0.13 μm process was designed for temperature independence and outputs a voltage of 175.5 mV with a temperature coefficient of only 3.6 ppm/° C., a supply voltage dependence of 0.033%/V, and power consumption of 2.2 pW. Additionally, the 1350 $\mu m^2$ reference operates correctly with the supply voltage as low as 0.5V at which point it consumes 2.22 pW.

Figure 2A:
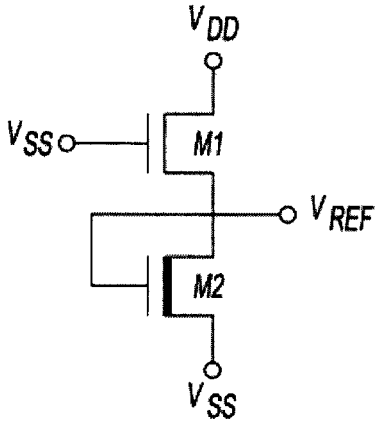
FIGS. 2A-2C are schematics of the reference voltage generator implemented with n-type transistors according to various embodiments.
Figure 2B:
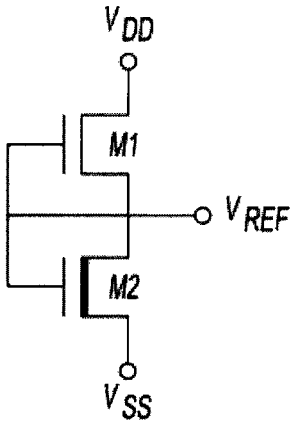
Figure 2C:
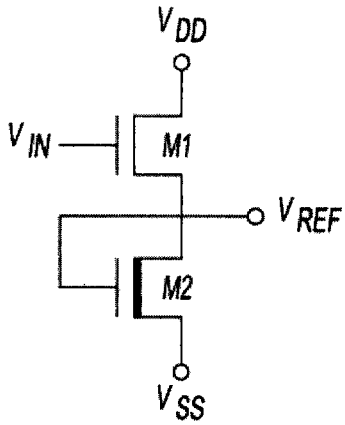
Figure 3A:
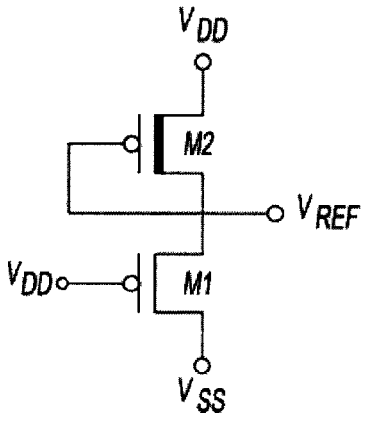
FIGS. 3A-3C are schematics of the reference voltage generator implemented with p-type transistors according to various embodiments.
Figure 3B:
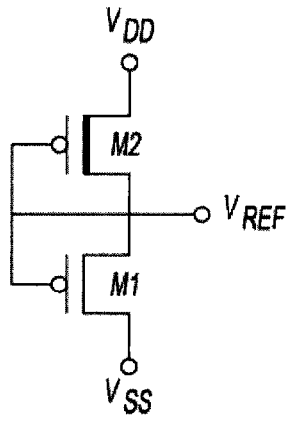
Figure 3C:
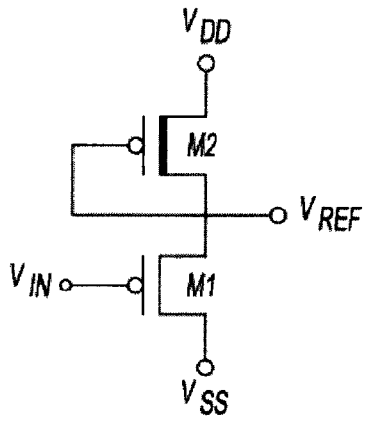

FIGS. 2A-2C illustrates three exemplary embodiments of the reference voltage generator 10 implemented with n-type transistors. The selection of the bias voltage $V_B$ is critical since any temperature dependence in this voltage alters the temperature dependence of $V_{REF}$. In FIG. 2A, the gate electrode of the first transistor M1 may be tied to the ground voltage $V_{SS}$, which is temperature independent. It should also be appreciated that one can make it linear to temperature by sizing W and L as mentioned herein, even though it is connected to Vss. In FIG. 2B, the gate electrode of the first transistor M1 is tied to the reference voltage $V_{REF}$, which has linear temperature dependence (and the linear slope may again assume a value of zero). In FIG. 2C, the gate electrode of the first transistor is tied to an external voltage $V_{IN}$, which has a temperature dependence determined by the circuit designer (for example, $V_{IN}$ may be the output of another reference voltage generator). It is again noted that each of the implementations may be implemented with P-type transistors as shown in FIGS. 3A-3C.

Figure 4A:
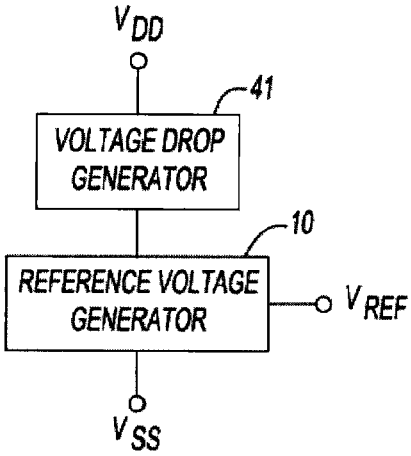
FIG. 4A is a schematic of the reference voltage generator connected in series with a voltage drop component.
Figure 4B:
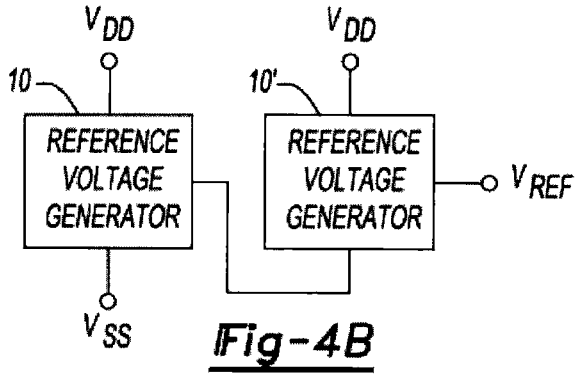
FIG. 4B is a schematic of the reference voltage generator cascaded with another reference voltage generator.
Figure 4C:
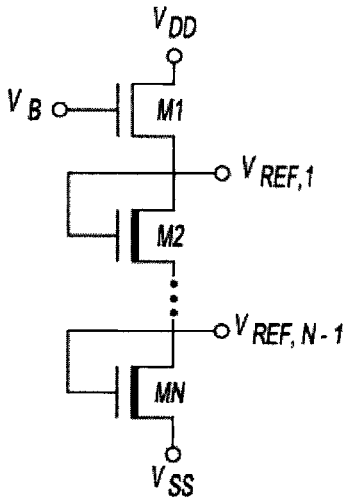
FIG. 4C is a schematic of the reference voltage generator configured to generate lower voltages.

Additional circuit arrangements for the reference voltage generator are depicted in FIGS. 4A-4C. FIG. 4A shows how a voltage drop 41 can be introduced in series between $V_{DD}$ and the reference voltage generator 10 to limit the maximum voltage dropped across the generator itself. In an exemplary embodiment, a diode or a diode-connected transistor could be used to insert a voltage drop on the order of 400-700 mV. FIG. 4B shows how two or more reference voltage generators 10 may be cascaded to output higher voltages. Note that the cascading can be extended by using multiple numbers of N-type based structures and/or P-type based structures to generate various reference voltages. FIG. 4C shows how the second transistor M2 may be replaced by two or more transistors to generate lower reference voltages. The lower reference voltages may also be tuned to have a linear dependence on temperature.

Process sensitivity is a common problem for most voltage reference generators and is typically addressed through trimming. However, trimming is often a time/cost intensive process, particularly if it involves laser trimming of resistors in the case of a bandgap voltage reference generator. Therefore, we propose a digitally trimmable version of the voltage reference generator design to improve temperature coefficient and output voltage accuracy across dies while reducing trimming time and cost. Measurements from a prototype chip in a 0.13 μm process show that trimming enables tighter distributions of temperature coefficient and nominal output voltage across 25 dies. The temperature coefficients lie between 5.3 ppm/° C. and 47.4 ppm/° C. while the nominal output varies by ±0.4% from the mean value. The voltage reference generator consumes 29.5 pW at 0.5V and 25° C.

Figure 5:
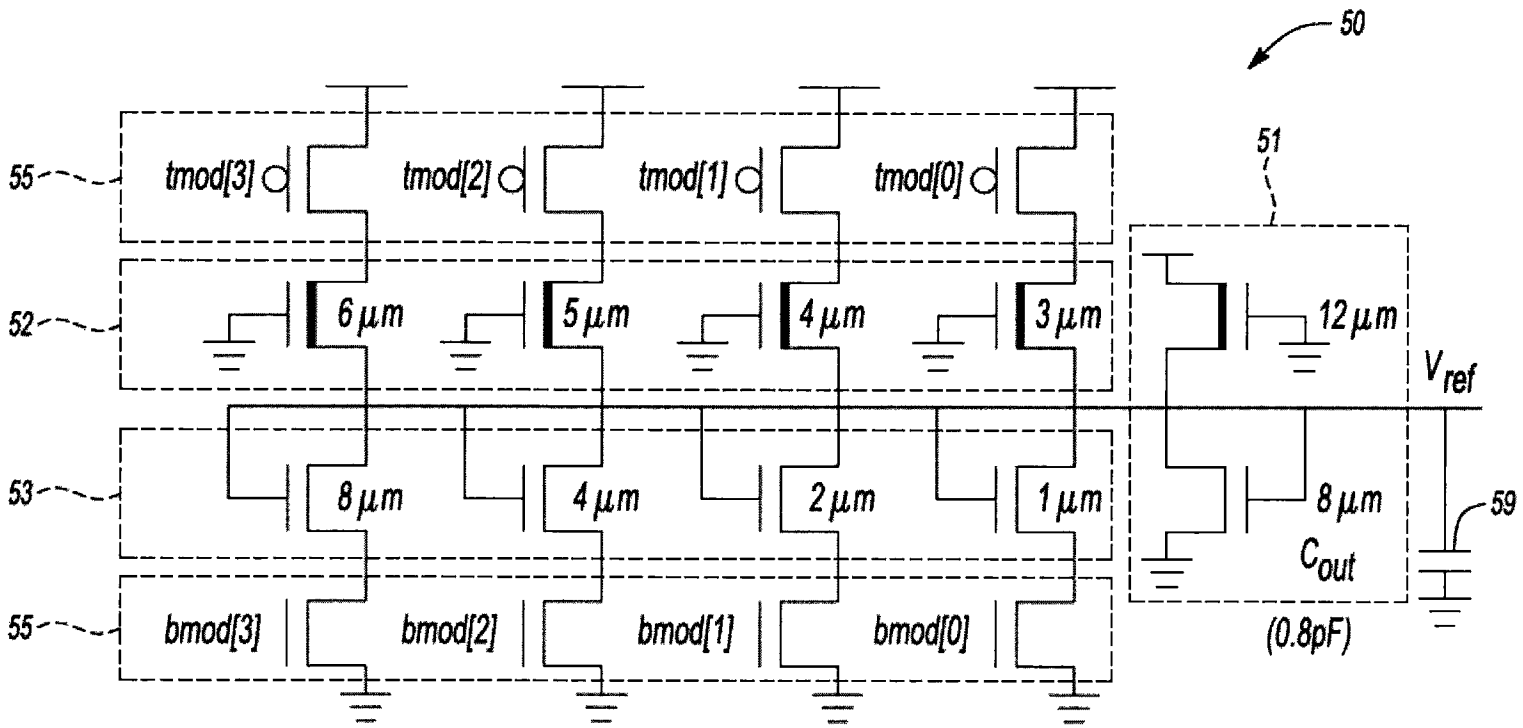
FIG. 5 is a schematic of a voltage reference generator with digital trimming capability.

To minimize the temperature coefficient and output voltage spread, a voltage reference generator system 50 with digital trimming is shown in FIG. 5. The ratio of top-to-bottom device widths is critical to temperature coefficient and output voltage. However, the optimal width ratio at design time may not be ideal for each chip due to process variations. Therefore, it is beneficial to be able to change the width ratio post-silicon.

In the exemplary embodiment, the voltage reference generator system 50 is constructed around a voltage reference generator 51 which serves as a baseline for the reference voltage output by the system. This baseline voltage reference generator 51 is constructed in accordance with the principles set forth above. A plurality of selectable transistors 52, 53 are connected in parallel with either the first transistor or the second transistor (or both as shown in the figure) of the baseline voltage reference generator 51. It is conceivable the baseline voltage reference generator may be eliminated where the system include a plurality of top and bottom selectable transistors as shown in the figure.

The selectable transistors can be selectively turned on or off to change the effective gate width amongst the transistors arranged in parallel. In this way, the effective width ratio of the voltage reference generator can be changed. In an exemplary embodiment, the gate electrodes amongst the plurality of selectable transistors may have different width sizes. For example, the plurality of selectable transistors 52 coupled in parallel with the first (or top) transistor are sized up gradually from the minimum width of ZVT devices (3 μm); whereas, the plurality of selectable transistors 53 coupled in parallel with the second (bottom) transistor are sized as powers of 2 for range and granularity as shown in FIG. 5. Other sizing arrangements for the selectable transistors are also contemplated by this disclosure including transistors having the same width sizes. Moreover, it is understood that trimming can be achieve using other techniques, such as changing the body bias, that change the strength of the first and/or second transistor. These techniques also fall within the broader aspects of this disclosure.

A plurality of control switches 55 may be used to selectively control operation of the selectable transistors 52, 53. By applying control signals bmod and tmod to the control switches, the top-to-bottom width ratio can be varied. In the exemplary embodiment, the top-to-bottom width ratio can be varied from 0.52 to 3.75 with 256 different settings. Control signals swing from 0 to $V_{dd}$, requiring no extra supply voltage. One-time-programmable memories such as fuses can be used to provide the signals with minimal power overhead. Once one or more of the control switches are turned off, any of the selectable transistors connected to them have negligible effect on the output voltage, acting as a dangling capacitor. Finally, an output capacitor 59 (e.g., 0.8 pF) may be added to suppress the effect of noise on output voltage.

Figure 6A:
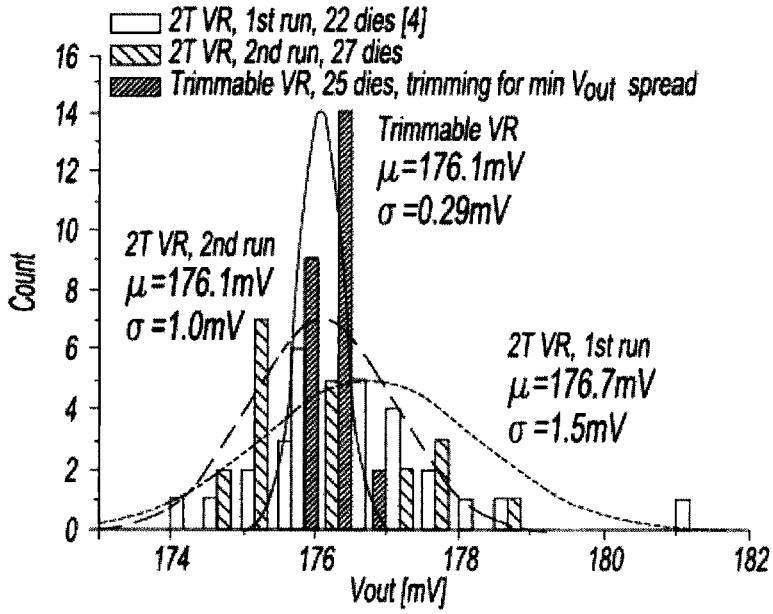
FIGS. 6A and 6B are graphs illustrating measurement results of output voltage and temperature coefficient distribution, respectively, for a voltage reference generator.
Figure 6B:
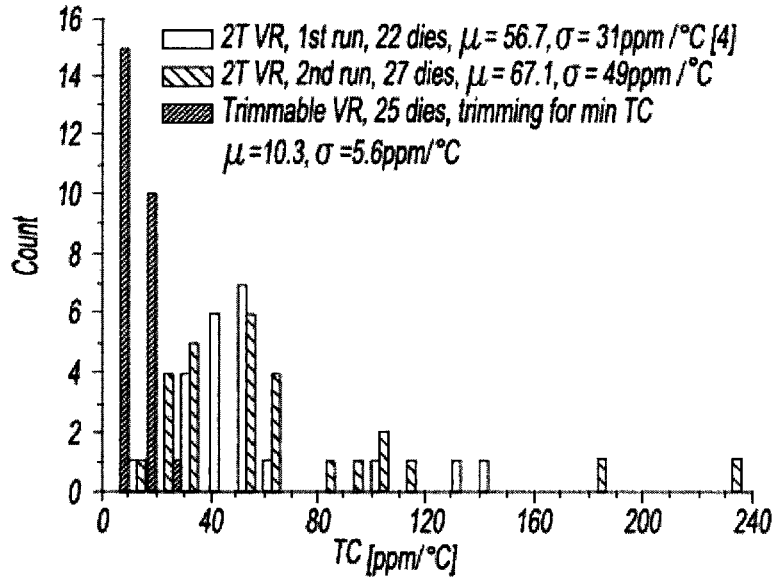

The trimmable voltage reference can be used to achieve consistently small temperature coefficient and/or very tight output voltage ranges. FIGS. 6A and 6B show measurement results for the voltage references from first and second fabrication runs. In FIG. 6A, the 3σ output voltage spread is reduced by ~$3.5^x$ from the untrimmed version while FIG. 6B shows a reduction in worst-case temperature coefficient of nearly $8^x$.

Figure 7A:
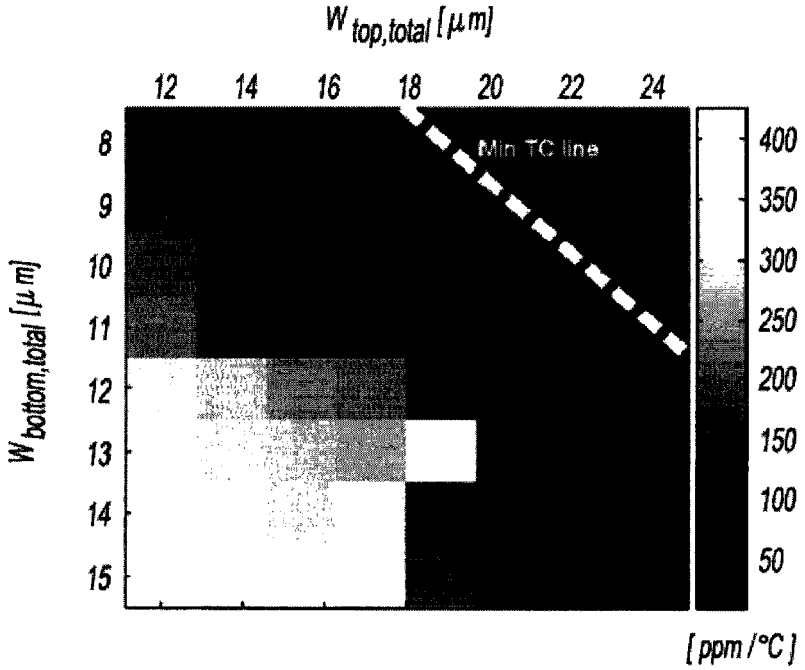
FIGS. 7A and 7B are graphs illustrating the temperature coefficient and output voltage design spacing for different settings in the trimmable voltage reference.
Figure 7B:
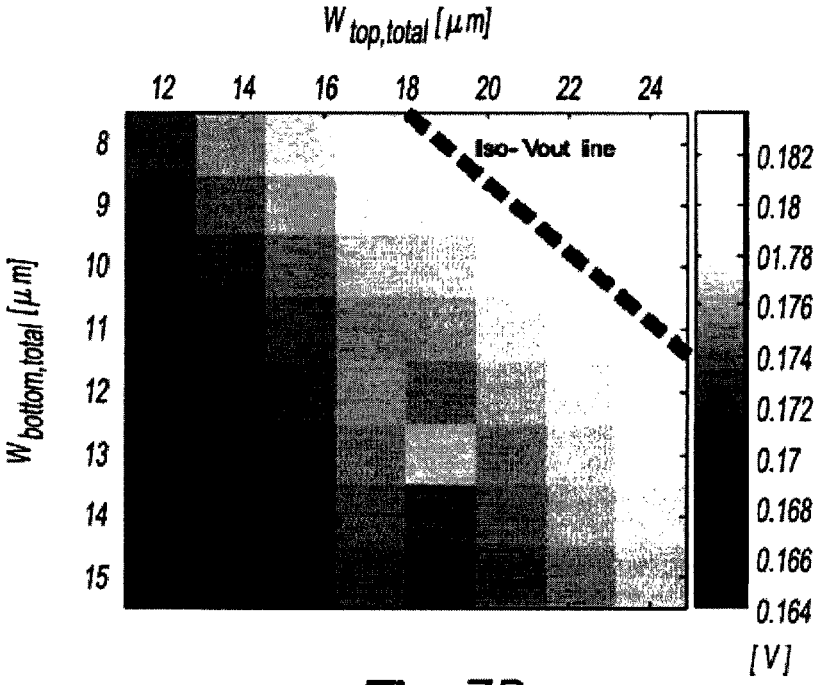

More likely the design goal will be to meet a specified temperature coefficient constraint with minimum deviation from the desired output voltage. FIGS. 7A and 7B illustrates the temperature coefficient and output voltage design spaces for different settings in the trimmable VR. FIG. 7A shows that for a given total width of top devices, for example 22 μm, setting the bottom device total width to 10 μm minimizes temperature coefficient. A clear trend is observed where a specific width ratio leads to minimum temperature coefficient, forming a diagonal line in the matrix. Likewise, output voltage changes at different settings, and depends directly on the width ratio. This is again confirmed by the diagonal line in FIG. 7B.

A trimming procedure is developed for the proposed voltage reference that balances minimal trimming time with optimal performance. To reduce testing time, the number of trim settings and temperatures during the trimming process is limited. At two temperature points (−20 and 80° C.), output voltages are measured by sweeping across 16 settings using two top device and eight bottom device widths. Then, an optimal setting for each die is chosen for given design objective. The objective is to minimize output voltage spread subject to temperature coefficient being less than 50 ppm/° C. After choosing the appropriate setting, each voltage reference is tested at a finer temperature granularity and it is observed that the temperature coefficient constraint remains met.

In summary, the reference voltage generator according to the current principles in this disclosure improves upon existing designs in four key areas: power consumption, design complexity, area, and minimum supply voltage. The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

What is claimed is:

1. A reference voltage generator comprising:

a first transistor having a first threshold voltage and a gate electrode biased to place the first transistor in a weak inversion mode; and a second transistor having same type of charge carrier as the first transistor and connected in series with said first transistor, the second transistor having a second threshold voltage and a gate electrode biased to place the second transistor in a weak inversion mode, where magnitude of the first threshold voltage is smaller than magnitude of the second threshold voltage and the gate electrode of the second transistor is electrically coupled to a drain electrode of the second transistor to form an output for a reference voltage.

2. The reference voltage generator of claim 1 wherein the gate electrodes of the first and second transistor are sized to make the reference voltage temperature independent.

3. The reference voltage generator of claim 1 wherein the gate electrodes of the first and second transistor are sized so that the reference voltage has a positive linear dependence on temperature.

4. The reference voltage generator of claim 1 wherein the gate electrodes of the first and second transistor are sized so that the reference voltage has a negative linear dependence on temperature.

5. The reference voltage generator of claim 1 wherein a difference between the first threshold voltage and the second threshold voltage exceeds 150 millivolts.

6. The reference voltage generator of claim 1 wherein the first and second transistors have a drain-to-source voltage that is more than three times a thermal voltage.

7. The reference voltage generator of claim 1 wherein the gate electrode of the first transistor is electrically coupled to a ground voltage.

8. The reference voltage generator of claim 1 wherein the gate electrode of the first transistor is electrically coupled to the reference voltage.

9. The reference voltage generator of claim 1 wherein the first and second transistors are n-type transistors, such that a drain electrode of the first transistor is electrically coupled to a supply voltage, a source electrode of the first transistor is electrically coupled to a drain electrode of the second transistor, and a source electrode of the second transistor is electrically coupled to a ground voltage.

10. The reference voltage generator of claim 1 wherein the first and second transistors are p-type transistors, such that a source electrode of the second transistor is electrically coupled to a supply voltage, a drain electrode of the second transistor is electrically coupled to a source electrode of the first transistor, and a drain electrode of the first transistor is electrically coupled to a ground voltage.

11. The reference voltage generator of claim 1 wherein the first and second transistors are further defined as metal oxide semiconductor field effect transistors.

12. The reference voltage generator of claim 1 further comprises a second voltage reference generator cascaded with the reference voltage generator to output a voltage that is higher than the reference voltage output by the reference voltage generator.

13. The reference voltage generator of claim 1 further comprises a third transistor connected in series with the second transistor, where the gate electrode of the third transistor is electrically coupled to a drain electrode of the third transistor to form an output for a voltage that is lower than the reference voltage output by the second transistor.

14. The reference voltage generator of claim 11 wherein the first, second and third transistors are n-type transistors, such that a drain electrode of the first transistor is electrically coupled to a supply voltage, a source electrode of the first transistor is electrically coupled to a drain electrode of the second transistor, a source electrode of the second transistor is electrically coupled to a drain electrode of the third transistor and a source electrode of the third transistor is electrically coupled to a ground voltage.

15. A reference voltage generator comprising:

a first transistor operated in a weak inversion mode, the first transistor having a source electrode, a drain electrode and a gate electrode; and a second transistor having same type of charge carrier as the first transistor and operated in a weak inversion mode, the second transistor having a drain electrode electrically coupled to the source electrode of the first transistor and a gate electrode electrically coupled to the drain electrode of the second transistor to form an output for a reference voltage, the second transistor having a magnitude of threshold voltage that is larger than a magnitude of threshold voltage of the first transistor, wherein the first and second transistors have a drain-to-source voltage that is more than three times a thermal voltage.

16. The reference voltage generator of claim 15 where width of the gate electrodes of the first and second transistor are sized to make the reference voltage temperature independent.

17. The reference voltage generator of claim 15 where width of the gate electrodes of the first and second transistor are sized so that the reference voltage has either a positive or negative linear dependence on temperature.

18. The reference voltage generator of claim 15 wherein a difference between the first threshold voltage and the second threshold voltage exceeds 150 millivolts.

19. A trimmable voltage reference system, comprising:

a first transistor having a first threshold voltage and a gate electrode biased to place the first transistor in a weak inversion mode;

a second transistor having same type of charge carrier as the first transistor and connected in series with said first transistor, the second transistor having a second threshold voltage and a gate electrode biased to place the second transistor in a weak inversion mode, where magnitude of the first threshold voltage is smaller than magnitude of the second threshold voltage and the gate electrode of the second transistor is electrically coupled to a drain electrode of the second transistor to form an output for a reference voltage; and a plurality of selectable transistors connected in parallel with at least one of first transistor and the second transistor.

20. The trimmable voltage reference system of claim 19 further comprises a plurality of first control switches, such that one of the first control switches is disposed between the supply voltage and one of the plurality of selectable transistors and the plurality of selectable transistors are connected in parallel with the first transistor, and a control module that selectively controls the plurality of first control switches.

21. The trimmable voltage reference system of claim 20 further comprises a plurality of additional selectable transistors connected in parallel with the second transistor and a plurality of second control switches, such that one of the second control switches is disposed between one of the plurality of additional selectable transistors and a ground voltage.

22. The trimmable voltage reference system of claim 19 further comprises a plurality of first control switches, such that one of the first control switches is disposed between the one of the plurality of selectable transistors and a ground voltage and the plurality of selectable transistors are connected in parallel with the second transistor, and a control module that selectively controls the plurality of first control switches.

23. The reference voltage generator of claim 1 wherein the first transistor being either a native transistor or an enhancement mode transistor and the second transistor being either a native transistor or an enhancement mode transistor.

* * * * *